US010125967B2

(12) United States Patent
Lockard

(10) Patent No.: US 10,125,967 B2
(45) Date of Patent: Nov. 13, 2018

(54) UNDERWATER LIGHT COVER KIT

(71) Applicant: Henry Lockard, Topeka, KS (US)

(72) Inventor: Henry Lockard, Topeka, KS (US)

( * ) Notice: Subject to any disclaimer, the term of this patent is extended or adjusted under 35 U.S.C. 154(b) by 0 days.

(21) Appl. No.: 15/685,567

(22) Filed: Aug. 24, 2017

(65) Prior Publication Data

US 2018/0058678 A1 Mar. 1, 2018

Related U.S. Application Data

(60) Provisional application No. 62/379,244, filed on Aug. 24, 2016.

(51) Int. Cl.

| | |
|---|---|
| ***F21V 31/00*** | (2006.01) |
| ***F21S 8/02*** | (2006.01) |
| ***F21V 15/01*** | (2006.01) |
| *F21W 131/401* | (2006.01) |
| *F21V 3/06* | (2018.01) |

(52) U.S. Cl.

CPC ..... *F21V 31/005* (2013.01); *F21S 8/024* (2013.01); *F21V 15/01* (2013.01); *F21V 3/061* (2018.02); *F21V 3/062* (2018.02); *F21W 2131/401* (2013.01)

(58) Field of Classification Search

CPC ..... F21V 31/00; F21V 31/005; F21V 3/061; F21V 3/062; F21S 8/024; F21W 2131/401

USPC ..... 362/267

See application file for complete search history.

(56) References Cited

U.S. PATENT DOCUMENTS

| | | | | |
|---|---|---|---|---|
| 5,800,041 | A * | 9/1998 | Poggi | F21S 8/024 362/101 |
| 6,798,154 | B1 * | 9/2004 | Sullivan | F21S 8/00 315/158 |
| 2004/0047145 | A1 * | 3/2004 | Koren | F21S 8/00 362/101 |
| 2008/0232106 | A1 * | 9/2008 | Brune | F21V 5/04 362/267 |
| 2009/0154164 | A1 * | 6/2009 | Hsu | F21S 8/00 362/267 |
| 2013/0170212 | A1 * | 7/2013 | Cuda | F21V 29/00 362/249.02 |
| 2014/0362578 | A1 * | 12/2014 | Dong | F21V 31/005 362/267 |
| 2017/0175992 | A1 * | 6/2017 | Guillet | F21V 3/062 |
| 2018/0080642 | A1 * | 3/2018 | Reichenbach | F21V 29/58 |

* cited by examiner

*Primary Examiner* — Paultep Savusdiphol
(74) *Attorney, Agent, or Firm* — RG Patent Consulting, LLC; Rachel Gilboy

(57) ABSTRACT

An underwater light cover kit for use upon a pool underwater light fixture includes a seal ring and an applicator ring. The seal ring has a circular shape having a circular aperture through a middle section thereof and is adapted to be placed upon a pool underwater light fixture having a circular shape. The applicator ring has a circular shape having a circular aperture through a middle section thereof and is adapted to be placed upon the seal ring and used to push the seal ring upon the pool underwater light fixture to deform the seal ring, push out air between the seal ring and the pool underwater light fixture and form the suction connection therebetween. A combination of a pool underwater light fixture and an underwater light cover kit, the combination includes a pool underwater light fixture and an underwater light cover kit.

14 Claims, 5 Drawing Sheets

UNDERWATER LIGHT COVER KIT

CROSS-REFERENCE TO RELATED APPLICATION

The present application is related to and claims priority from prior provisional application Ser. No. 62/379,244, filed Aug. 24, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of pool lighting devices and more specifically relates to an underwater light cover kit for use upon a pool underwater light fixture structured and arranged that will create a water-tight seal around the light and niche for an underwater light in a pool. The present invention comprises suction that holds the cover securely in place with a tight seal, and it can be applied without having to drain the pool.

2. Description of the Related Art

When the light niche that encases the underwater light in a pool cracks or deteriorates, it must be repaired. Many light niches continue to leak, even after attempts have been made to seal the damage with caulk. Doing a thorough repair job can be an expensive and time-consuming job. A thorough repair may require that the pool be drained, or, perhaps, the decking above the leak source may need to be removed in order to make the repair, as it is nearly impossible to make a lasting repair underwater. Therefore, a need exists for a specially design more permanent and attractive cover, which can be installed easily to stop the leak within a very short time.

Various attempts have been made to solve problems found in pool lighting devices art. Among these are found in: U.S. Pat. No. 8,783,634 to Summers et al.; U.S. Pat. No. 9,188,225 to Drew K. White; U.S. Pat. No. 9,128,002 to Mark D. Marino; U.S. Pat. No. 7,705,240 to Armstrong et al.; U.S. Pat. No. 7,188,378 to Richard T. Ryan. A need exists for a reliable Light Niche Leak Cap to avoid the above-mentioned problems.

Ideally, a underwater light cover kit for use upon a pool underwater light fixture should be user-friendly and safe in-use and, yet may operate reliably and be manufactured at a modest expense. Thus, a need exists for an underwater light cover kit for use upon a pool underwater light fixture structured and arranged that will create a water-tight seal around the light and niche for an underwater light in a pool. The present invention comprises suction that holds the cover securely in place with a tight seal, and it can be applied without having to drain the pool and to avoid the above mentioned problems.

BRIEF SUMMARY OF THE INVENTION

In view of the foregoing disadvantages inherent in the known pool lighting devices art, the present invention provides an underwater light cover kit for use upon a pool underwater light fixture. The general purpose of the present invention, which will be described subsequently in greater detail is to provide an underwater light cover kit for use upon a pool underwater light fixture structured and arranged that will create a water-tight seal around the light and niche for an underwater light in a pool. The present invention comprises suction that holds the cover securely in place with a tight seal, and it can be applied without having to drain the pool.

An underwater light cover kit for use upon a pool underwater light fixture, comprising: a seal ring and an applicator ring. The seal ring is formed from a flexible waterproof material. The seal ring has a circular shape having a circular aperture through a middle section thereof and is adapted to be placed upon a pool underwater light fixture having a circular shape. The seal ring has a curved cross-section adapted such that when the seal ring is placed upon the pool underwater light fixture an air pocket is formed, and when the seal ring is pressed upon the pool underwater light fixture it deforms and pushes out air therebetween forming a suction connection therebetween.

The applicator ring has a circular shape having a circular aperture through a middle section thereof and is adapted to be placed upon the seal ring and used to push the seal ring upon the pool underwater light fixture to deform the seal ring, push out air between the seal ring and the pool underwater light fixture and form the suction connection therebetween. The seal ring is in place upon the pool underwater light fixture and the suction connection is achieved, the pool underwater light fixture becomes protected from pool water the pool underwater light fixture is located in.

A combination of a pool underwater light fixture and an underwater light cover kit, the combination comprising: a pool underwater light fixture and an underwater light cover kit.

The present invention holds significant improvements and serves as an underwater light cover kit for use upon a pool underwater light fixture. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Underwater Light Cover Kit for Use Upon a Pool Underwater Light Fixture, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate pool lighting devices and more specifically relates to an underwater light cover kit for use upon a pool underwater light fixture structured and arranged that will create a water-tight seal around the light and niche for an underwater light in a pool. The present invention comprises suction that holds the cover securely in place with a tight seal, and it can be applied without having to drain the pool.

Generally speaking, an underwater light cover kit for use upon a pool underwater light fixture is designed to provide a quick and easy way to seal an underwater light in a pool. It will be used to create a water-tight seal around the light fixture and its frame, using suction to keep it in place. It is basically a piece of clear plastic with rubber silicone frame that covers the light fixture and its frame. A thin acrylic ring that covers the diameter of the silicone frame completely is used to press the cover down around the frame of the light fixture. This should create a water-tight seal around the outside of the light fixture and around the outside edges of its frame. As it may be difficult to create the suction needed to hold the cover in place in a concrete or plaster pool, an adhesive that can be used underwater, like Underwater Magic and Mr. Sticky's, can be applied to the underside of the rubber ring before it is fitted around the light fixture.

Figure 1:
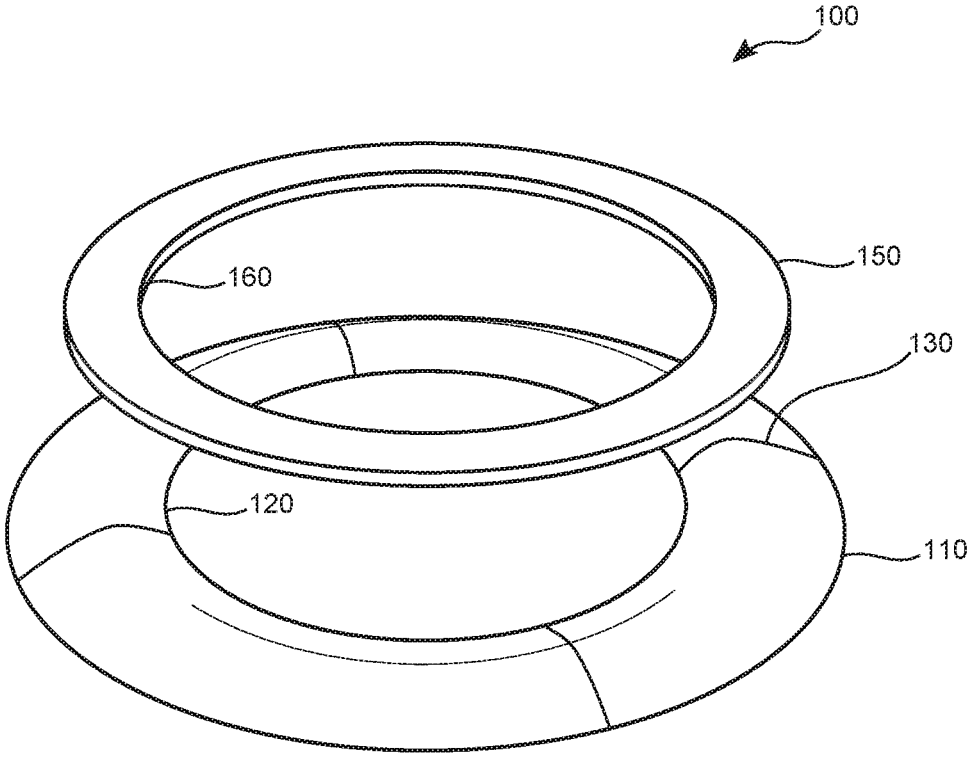
FIG. 1 shows a perspective view illustrating an Underwater Light Cover Kit for Use Upon a Pool Underwater Light Fixture according to an embodiment of the present invention.
Figure 2:
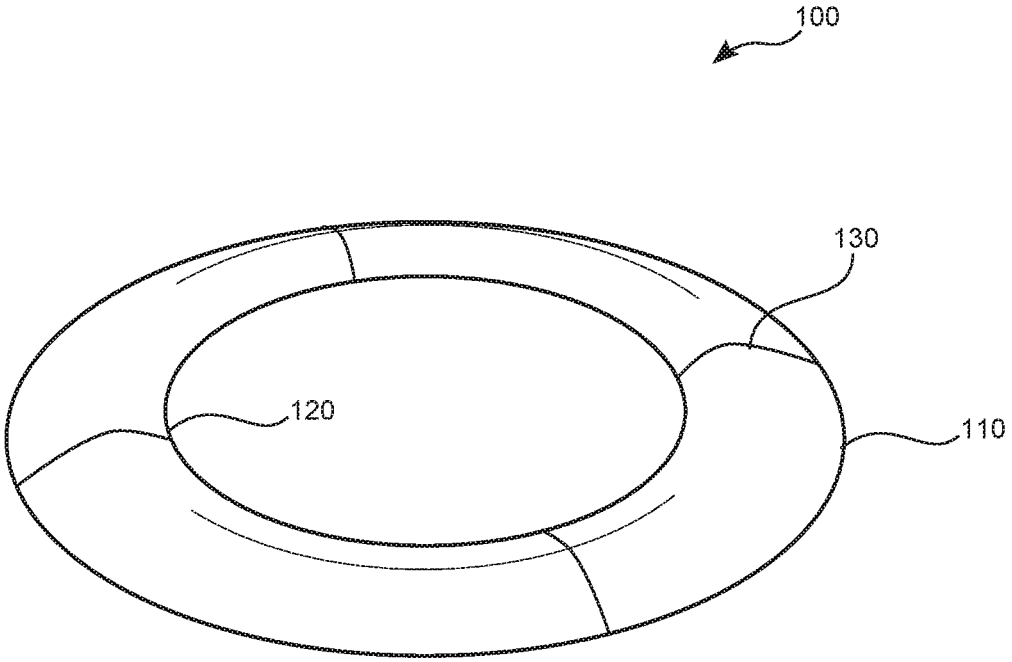
FIG. 2 is a perspective view illustrating a flexible seal ring of the Underwater Light Cover Kit for Use Upon a Pool Underwater Light Fixture according to an embodiment of the present invention of FIG. 1.
Figure 3:
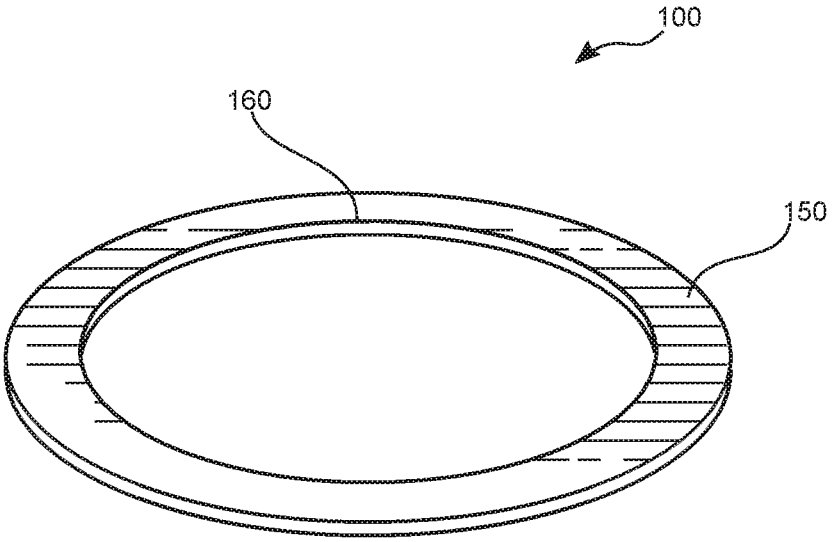
FIG. 3 is a perspective view illustrating an applicator ring of the Underwater Light Cover Kit for Use Upon a Pool Underwater Light Fixture according to an embodiment of the present invention of FIG. 1.

The unique features of this product will provide the following benefits all pool owners:

- A simple, watertight repair when it has been determined a water leak exists through or around the light niche
- The rubber ring could then be customized with colors, patterns or clear rubber to better fit different light frames and to match the color of the pool's interior
- When there are many other repairs needed on a pool, this is one that can be completed quickly and easily
- Will eliminate spending time and money draining and refilling the pool or tearing apart the deck above the leak to repair it Referring to the drawings by numerals of reference there is shown in FIGS. 1-3 shows perspective views illustrating an Underwater Light Cover Kit 100 for Use Upon Pool Underwater Light Fixture 410 according to an embodiment of the present invention.

Underwater light cover kit 100 for use upon a pool underwater light fixture 410, comprising: seal ring 110 and applicator ring 150. Seal ring 110 is formed from a flexible waterproof material. Seal ring 110 has a circular shape having circular aperture 120 through a middle section thereof and is adapted to be placed upon pool underwater light fixture 410 having a circular shape as shown in in-use condition 490 of FIG. 4. Seal ring 110 has curved cross-section 130 adapted such that when seal ring 110 is placed upon pool underwater light fixture 410, an air pocket is formed, and when seal ring 110 is pressed upon pool underwater light fixture 410 it deforms and pushes out air therebetween forming a suction connection therebetween as shown in FIG. 4.

Applicator ring 150 has a circular shape having a circular aperture 160 through a middle section thereof and is adapted to be placed upon seal ring 110 and used to push seal ring 110 upon pool underwater light fixture 410 to deform seal ring 110, push out air between seal ring 110 and pool underwater light fixture 410 and form the suction connection therebetween. Seal ring 110 is in place upon pool underwater light fixture 410 and the suction connection is achieved, pool underwater light fixture 410 becomes protected from pool water pool underwater light fixture 410 is located in.

Figure 4:
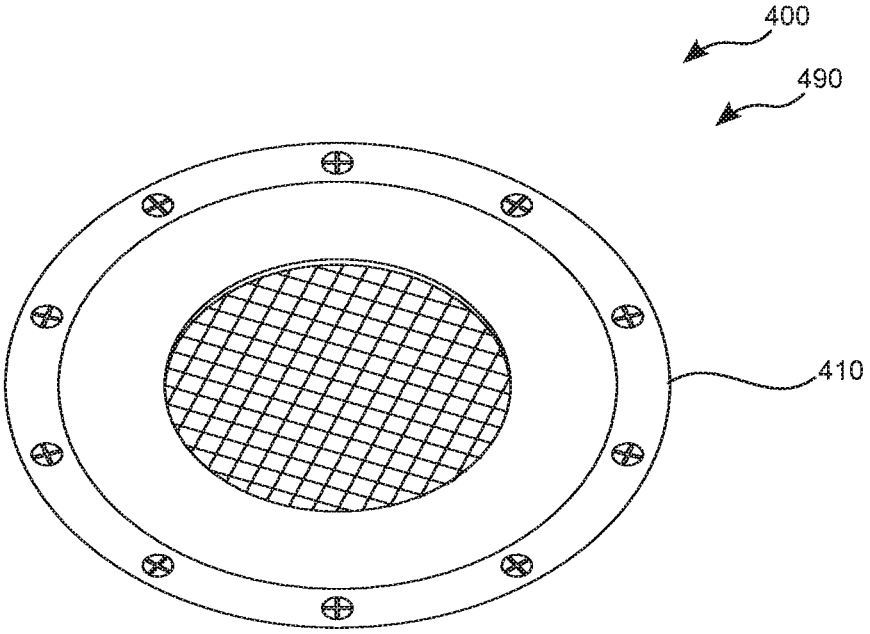
FIG. 4 is a perspective view illustrating a combination of a pool underwater light fixture and an underwater light cover kit according to an embodiment of the present invention of FIG. 1.
Figure 5:
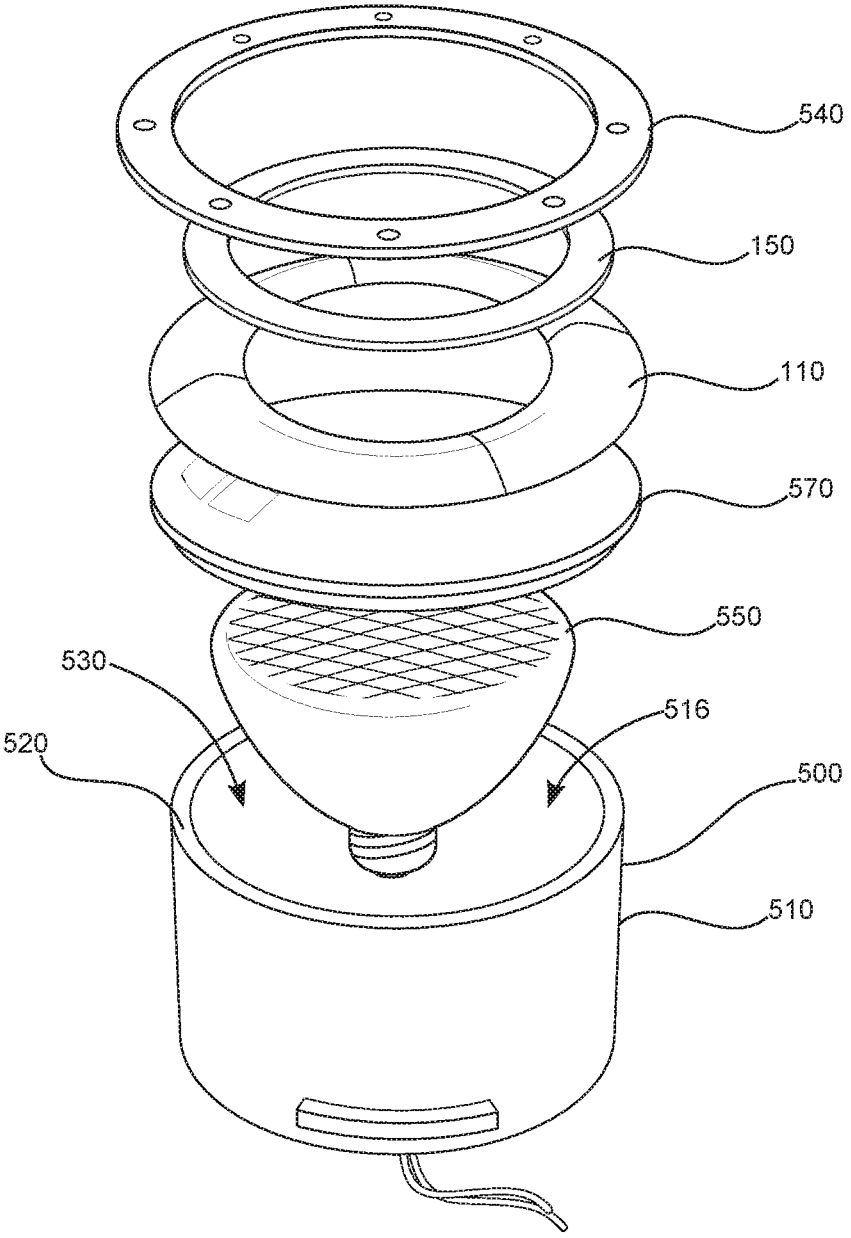
FIG. 5 is a perspective view illustrating another the combination of a pool underwater light fixture and an underwater light cover kit according to an embodiment of the present invention of FIG. 1.

Referring now to FIGS. 4 & 5, combination 400 of pool underwater light fixture 410 and underwater light cover kit 100.

Combination 400 of a pool underwater light fixture 410 and underwater light cover kit 100, combination 400 comprising: pool underwater light fixture 410 and underwater light cover kit 100. Pool underwater light fixture 410 includes: main housing 500; electric light member 550; and cover member 570. Main housing 500 includes at least one wall member 510 and connector flange 540. At least one wall member 510 forms interior volume 516, circumferential edge portion 520, and main aperture 530 defined by circumferential edge portion 520. Connector flange 540 connected to and extending outwardly from circumferential edge portion 520 and adapted to be secured to a wall of a pool, and thereby adapted to secure pool underwater light fixture 410 to the wall of the pool.

Electric light member 550 is located within interior volume 516 of main housing 500 and is adapted to be electrically connected to an external power supply. Cover member 570 is releasably connected to main housing 500 and is adapted to cover main aperture 530. Cover member 570 is formed from material adapted to allow light to pass therethrough.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An underwater light cover kit for use upon a pool underwater light fixture, comprising:

a seal ring;

wherein said seal ring is formed from a flexible waterproof material;

wherein said seal ring has a circular shape having a circular aperture through a middle section thereof and is adapted to be placed upon a pool underwater light fixture having a circular shape; and wherein said seal ring has a curved cross-section adapted such that when said seal ring is placed upon said pool underwater light fixture an air pocket is formed, and when said seal ring is pressed upon said pool underwater light fixture it deforms and pushes out air therebetween forming a suction connection therebetween;

an applicator ring;

wherein said applicator ring has a circular shape having a circular aperture through a middle section thereof and is adapted to be placed upon said seal ring and used to push said seal ring upon said pool underwater light fixture to deform said seal ring, push out air between said seal ring and said pool underwater light fixture and form said suction connection therebetween;

wherein when said seal ring is in place upon said pool underwater light fixture and said suction connection is achieved, said pool underwater light fixture becomes protected from pool water said pool underwater light fixture is located in.

2. The underwater light cover kit of claim 1, wherein a circumference of said applicator ring is equal to a circumference of said seal ring.

3. The underwater light cover kit of claim 1, wherein said flexible waterproof material of said seal ring is chosen from a group of flexible waterproof materials consisting of plastic, rubber, and silicone.

4. The underwater light cover kit of claim 1, wherein said applicator ring is formed from a rigid material chosen from a group of rigid materials consisting of plastic, aluminum, steel, acrylic, and ceramic.

5. A combination of a pool underwater light fixture and an underwater light cover kit, said combination comprising:

a pool underwater light fixture including:

a main housing including:

at least one wall member forming an interior volume, a circumferential edge portion, and a main aperture defined by said circumferential edge portion; and a connector flange connected to and extending outwardly from said circumferential edge portion and adapted to be secured to a wall of a pool, and thereby adapted to secure said pool underwater light fixture to said wall of said pool;

an electric light member;

wherein said electric light member is located within said interior volume of said main housing and is adapted to be electrically connected to an external power supply; and a cover member;

wherein said cover member is releasably connected to said main housing and is adapted to cover said main aperture; and wherein said cover member is formed from material adapted to allow light to pass therethrough; and an underwater light cover kit comprising:

a seal ring;

wherein said seal ring is formed from a flexible waterproof material;

wherein said seal ring has a circular shape having a circular aperture through a middle section thereof and is adapted to be placed upon and cover said circumferential edge portion, said connector flange, and a portion of said cover member of said pool underwater light fixture; and wherein said seal ring has a curved cross-section adapted such that when said seal ring is placed upon said circumferential edge portion, said connector flange, and said portion of said cover member of said pool underwater light fixture an air pocket is formed, and when said seal ring is pressed it deforms and pushes out air therebetween forming a suction connection therebetween;

an applicator ring;

wherein said applicator ring has a circular shape having a circular aperture through a middle section thereof and is adapted to be placed upon said seal ring and used to push said seal ring upon said circumferential edge portion, said connector flange, and said portion of said cover member of said pool underwater light fixture to deform said seal ring, push out air therebetween and form said suction connection therebetween;

wherein when said seal ring is in place upon said circumferential edge portion, said connector flange, and said portion of said cover member of said pool underwater light fixture and said suction connection is achieved, said pool underwater light fixture becomes protected from pool water said pool underwater light fixture is located in.

6. The combination of claim 5, wherein a circumference of said applicator ring is equal to a circumference of said seal ring.

7. The combination of claim 5, wherein said flexible waterproof material of said seal ring is chosen from a group of flexible waterproof materials consisting of plastic, rubber, and silicone.

8. The combination of claim 5, wherein said applicator ring is formed from a rigid material chosen from a group of rigid materials consisting of plastic, aluminum, steel, acrylic, and ceramic.

9. The combination of claim 5, wherein said pool underwater light fixture further comprises at least one connector member adapted to connect said connector flange of said main housing to a wall of said pool.

10. The combination of claim 9, wherein said at least one connector member is formed as a screw member.

11. The combination of claim 9, wherein said at least one connector member is formed from a silicone liquid.

12. The combination of claim 5, wherein said cover member of said pool underwater light fixture is formed from a semi-transparent material.

13. The combination of claim 5, wherein said cover member of said pool underwater light fixture is formed from a material chosen from a group of materials consisting of plastic and glass.

14. The combination of claim 5, wherein said main housing is formed from a material chosen from a group of materials consisting of plastic, aluminum, steel, acrylic, and ceramic.

* * * * *